US005255455A

United States Patent [19]

Hopper

[11] Patent Number: 5,255,455

[45] Date of Patent: Oct. 26, 1993

[54] ADJUSTABLE FRAME FOR SCROLLING AND STRETCHING NEEDLEPOINT FABRICS

[75] Inventor: David G. Hopper, 131 E. Sandle Ave., Pittsburgh, Pa. 15237

[73] Assignee: David G. Hopper, Pittsburgh, Pa.

[21] Appl. No.: 927,457

[22] Filed: Aug. 10, 1992

[51] Int. Cl.[5] ..... D06C 3/08

[52] U.S. Cl. ..... 38/102.1; 38/102.4; 38/102.9; 38/102.91

[58] Field of Search ..... 38/102, 102.1, 102.3, 38/102.5, 102.6, 102.7, 102.91; 209/403–405; 160/371, 372, 374.1, 378, 379, 381, 382; 289/18.1

[56] References Cited

U.S. PATENT DOCUMENTS

| | | | |
|---|---|---|---|
| 300,609 | 6/1884 | Johnson | 38/102.1 |
| 1,949,061 | 2/1934 | Male | 38/102.91 |
| 2,821,883 | 2/1958 | Rusch | 160/382 |
| 3,098,280 | 7/1963 | Harris et al. | 38/102.91 |
| 4,315,645 | 2/1982 | Knox | 289/18.1 |
| 4,430,815 | 2/1984 | Wulc | 38/102.91 |
| 4,614,049 | 9/1986 | Riley et al. | 38/102.91 |
| 4,625,440 | 12/1986 | Dang et al. | 38/102.5 |
| 4,893,423 | 1/1990 | Heinrich | 38/102.1 |
| 5,027,989 | 7/1981 | Nevius | 38/102.1 |
| 5,097,761 | 3/1992 | Hamu | 101/127.1 |

FOREIGN PATENT DOCUMENTS

| | | | |
|---|---|---|---|
| 2479861 | 10/1981 | France | 38/102.1 |
| 0549259 | 10/1956 | Italy | 38/102.1 |
| 0016911 | 12/1887 | United Kingdom | 38/102.1 |

*Primary Examiner*—Clifford D. Crowder
*Assistant Examiner*—Ismael Izaguirre

[57] ABSTRACT

A fabric stretching device having a primary upright frame support (10) and secondary upright frame support (18) which are parallel to each other. These supports are held apart at a defined distance by a front and a rear frame brace (12*a,b*) which are parallel to each other and connect perpendicularly to the top and bottom ends of both upright frame supports, forming a rigid rectangular frame such that the height of the frame is defined by the distance between the frame braces, and the width of the frame is defined by the distance between the upright frame supports. A front and rear scroller rod (24*a,b*) pass through the upright frame supports inward of and parallel to the frame braces such that fabric is attached to the scroller rods by inserting the fabric through a scroller rod fabric slot (26) which is cut through each scroller rod. The rear scroller rod is inserted through either of two holes in the frame supports, enabling adjustment of the distance between the front and rear scroller rods. Scroller rods rotate via use of scroller knobs (28) located at the end of the scroller rods, scrolling fabric sections into the work area as defined by the distance between the scroller rods. A clamp knob (34) screws through the top surface of the primary upright support and applies pressure onto each scroller rod to prevent the scroller rods from releasing fabric tension. The aforementioned invention is formed to enable assembly disassembly.

1 Claim, 3 Drawing Sheets

ADJUSTABLE FRAME FOR SCROLLING AND STRETCHING NEEDLEPOINT FABRICS

BACKGROUND OF THE INVENTION

1. Field of the Invention

This invention pertains to fabric stretching devices which provide clear access to stretched fabric while holding the fabric taut, enabling efficient needlepoint work to be performed upon the fabric.

2. Description of the Related Art

Heretofore, needlepoint stretchers have provided either a rigid, non—adjustable frame, or an adjustable frame at the sacrifice of rigid construction. Known to the inventor is a commercially available fabric stretcher for which no specific reference or documentation as prior art exists. This device utilizes two parallel upright arms and two rods which pass horizontally through the upright arm ends in a perpendicular fashion. Fabric is then wrapped around and stretched between the horizontal rods. The aforementioned design is commonly referred to as a "scroll stretcher", and this basic concept is utilized in U.S. Pat. No. 4,471,542 to Donald J. Unbenhauer (1984) and U.S. Pat. No. 3,098,280 to Harris Et Al (1963). Both of these aforementioned inventions modify the basic scroll stretcher design by using clamps which are integrated into the upright parallel arms, serving to stretch the fabric in a horizontal direction while fabric tension between the two scrolling rods maintains vertical tension. In studying these types of designs, however, the inventor has found that horizontal stretching of the fabric is necessary only because the rigidity of the frame is reduced whenever the rod clamps (thumb screws, in both cases) are loosened in order to turn the scrolling rods, an operation necessary in order to transport a new section of fabric into the work area as defined by the distance between the two scrolling rods. When frame rigidity is compromised, torsion caused by lack of rigidity between the upright parallel arms and the horizontal rods causes the frame to twist, resulting in diagonal ripples or lateral sags in the fabric. Thus, the two previously cited inventions compensate for their non-rigid, overly flexible frames by clamping the sides of the fabric and stretching the fabric transversely.

Also inherent in the design of previously cited scroll frame inventions (Umbenhauer and Harris Et Al), is a necessarily close tolerance between the horizontal rods and the holes in the upright frame members through which these rods pass. This tight fit is necessary because rod clamps must bend the upright arms, reducing the size of the holes through which the scroll rods pass in order to immobilize the rods and provide relative frame rigidity with minimum user effort. As the previously cited inventions are dependent on tight scroll rod compression for provision of a rigid frame, the scroll rods must be fitted in tight holes, resulting in friction between the upright arms and the horizontal rods. This friction results in difficulty of scroll rod adjustment.

Previously cited scroll type fabric stretchers (Umbenhauer and Harris Et Al) provide no capability for adjustment of the distance between the scroll rods. This capability is desirable because it enables the work area to be reduced to allow shorter fabrics to be mounted within the work area between the scroll rods.

Another crucial factor to be considered in scroll-type fabric stretchers is the manner in which the fabric is attached to the horizontal rods. Unbenhauer shows an ordinary, unaltered rod for fabric attachment, necessitating the use of adhesive tape or some other method in order to secure the fabric to the scrolling rod. Use of such tape may discolor, unravel, tear, or otherwise damage the fabric upon removal from the rod. The tape may also lose adhesion to either the fabric or rod during use, inconveniencing the user who must then re-fasten the fabric to the rod. In the previously mentioned invention by Harris Et Al, an exceptionally complex fabric holding rod is specified, utilizing over twenty parts in the rod assembly alone. This complexity, while possibly effective, virtually eliminates the invention from the competitive marketplace due to exceptionally high manufacturing costs.

Other stretcher designs, such as U.S. Pat. No. 800,591 to C. Payen (1905), provide a rigid frame on which fabric can be uniformly stretched, however the maximum fabric size is limited to the size of the frame itself.

SUMMARY OF THE INVENTION

An object of the Needlework Scroller is to provide a frame upon which fabric used for needlepoint or other stitching projects are mounted, and wherein said fabric is conveniently accessed from both top and bottom as is necessary for proficient stitching. The aforementioned frame must be convenient to use, light in weight, aesthetically appealing, and relatively simple in construction in order to ensure its viability in the competitive marketplace. Further objects and advantages of the present invention are:

a) to construct a stitching frame which is constantly rigid, particularly during fabric adjustment.

b) to utilize movable, or scrolling, horizontal rods which enable the user to wrap excess lengths of fabric around the rods so that no excess fabric inconveniently falls beyond the frame of the stretcher, where it can be inadvertently stained or snagged. This object will also enable the user to scroll sections of the fabric into and out of the center, or work area of the frame, enabling the user to complete stitching on a piece of fabric much longer than the height of the frame being used, without removing the fabric from the frame.

c) to integrate a method of scroll rod immobilization, necessary to maintain fabric tension. This method must be convenient and require very little user effort.

d) to provide a method of fabric attachment which is convenient, effective, and does not require the use of adhesives.

e) to integrate a method of vertical adjustment whereby the stitcher may choose a work area size which best suits the size of fabric being used.

f) to provide a fabric stretching device which can be completely disassembled. This feature enables the stretcher to be compacted into smaller packaging, a commercial advantage resulting in reduced shipping and packaging costs, as well as enabling the consumer to disassemble the stretcher for ease of transportation. Disassembly also enables the use of different lengths of horizontal rods, to enable frame width adjustments for different widths of fabrics.

Further improvements, objects, and advantages will become apparent in the ensuing descriptions and drawings.

BRIEF DESCRIPTION OF THE DRAWINGS

Figure one shows an overall view of the Needlework Scroller. A rectangular frame assembly is comprised of primary upright frame support 10 and secondary upright frame support 18. Front frame brace 12*a* and rear frame brace 12*b* are parallel to each other and are attached perpendicularly to the primary and secondary supports. Front scroller rod 24*a* and rear scroller rod 24*b* pass through the secondary upright frame support and the primary upright frame support and are mounted inward and parallel to the front and rear braces. The front scroller rod passes through lower scroller holes 11*a,b* and the rear scroller rod passes through either the upper scroller holes 15*a,b* or the middle scroller holes 13*a,b*.

Figure two shows an exploded view of the top half of primary upright frame support 10 and adjoining components. Rear frame brace 12*b* is attached to the primary support via use of threads, a male—threaded end of the rear brace threading into the upper female—threaded hole of primary upright frame support 16. The rear brace becomes rigid when threaded tightly into the lateral threaded hole of the primary support. Front frame brace 12*a* is threaded into the lower female—threaded hole of primary support 17 (FIG. 1) in the same manner as the rear brace is attached to the primary support as shown in FIG. 2 and described above.

FIG. 3 also shows rear scroller rod 24*b*, which is cut lengthwise through its center to form fabric slot 26. The end of the rear scroller rod is affixed into the hole of scroller knob 28. The rear scroller rod is then inserted through either the secondary upper scroller rod hole 15*b* and the primary upper scroller rod hole 15*a* (FIG. 1) or the secondary middle scroller rod hole 13*b* and the primary middle scroller rod hole 13*a* (FIG. 1). To prevent the rear scroller rod from sliding back through the primary scroller rod hole, scroller rod stop peg 32 (FIG. 2) is inserted into scroller rod stop peg hole 33, which is drilled perpendicularly to and through the center of the rear scroller rod. Front scroller rod 24*a* (FIG. 1) passes through the secondary lower scroller hole 11*b* and the primary lower scroller hole 11*a* and is assembled in the same manner as the rear scroller rod described above.

Figure 3:
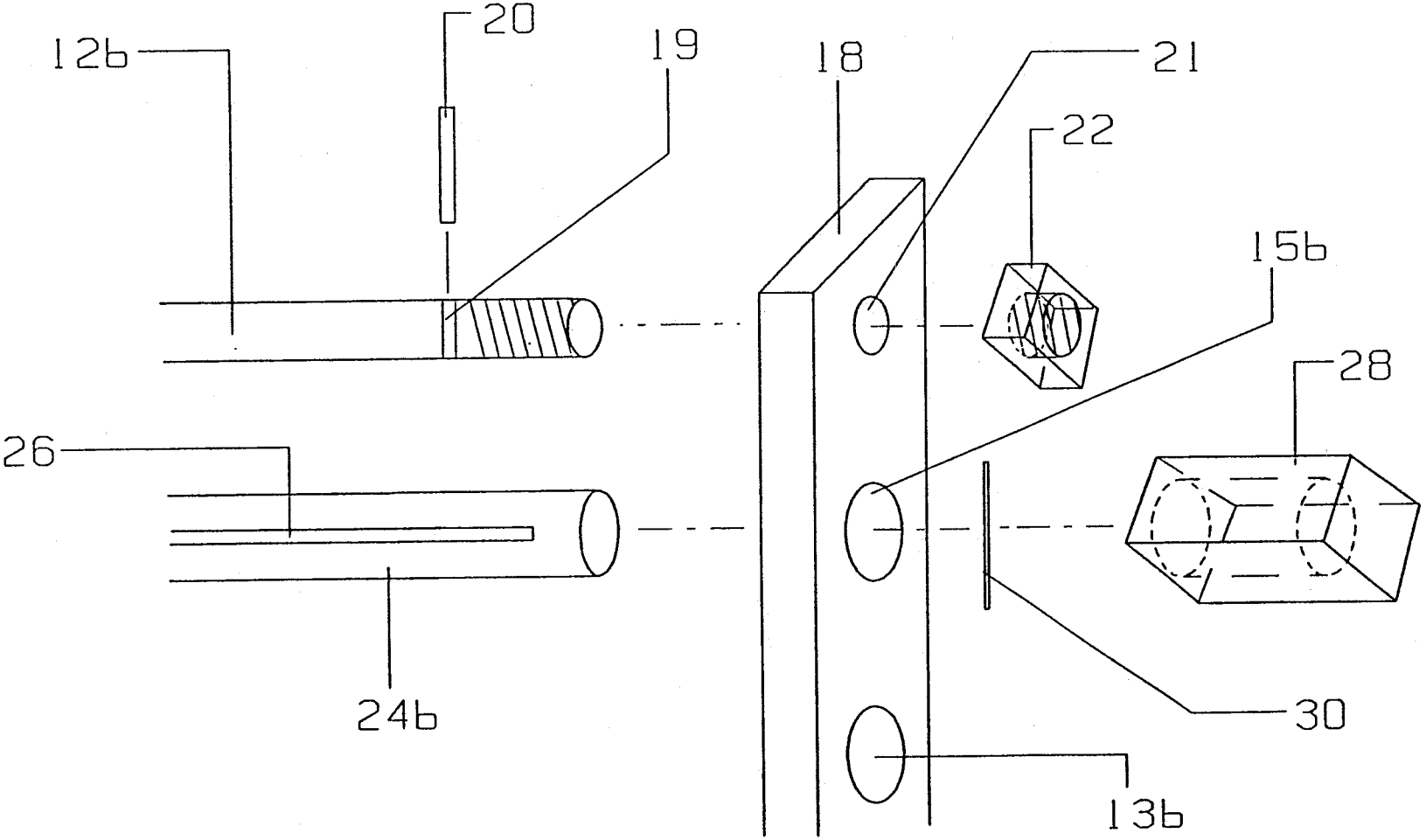
FIG. 3 shows an exploded view of the top half of secondary upright frame support 18 and the manner in which rear frame brace 12*b* and rear scroller rod 24*b* are attached to the secondary support. Frame brace stop peg 20 is inserted through brace stop peg hole 19. Upper frame brace hole 21 is sized such that the rear brace slides easily through the upper frame brace hole until the brace stop peg contacts the inner surface of the secondary support. An end of the rear brace is threaded to enable female—threaded frame brace nut 22 to screw down onto the rear brace until the secondary support is compressed tightly between the frame brace stop peg and the frame brace nut. Front frame brace 12*a* slides through lower frame brace hole 23 (FIG. 1) and is attached to the secondary support in the same manner as the rear brace is attached to the secondary support as shown in FIG. 3 and described above.

Washer 30 (FIG. 3) reduces friction and prevents scroller knob 28 from scratching the surface of secondary upright frame support 18 during scroller rod rotation.

Figure 1:
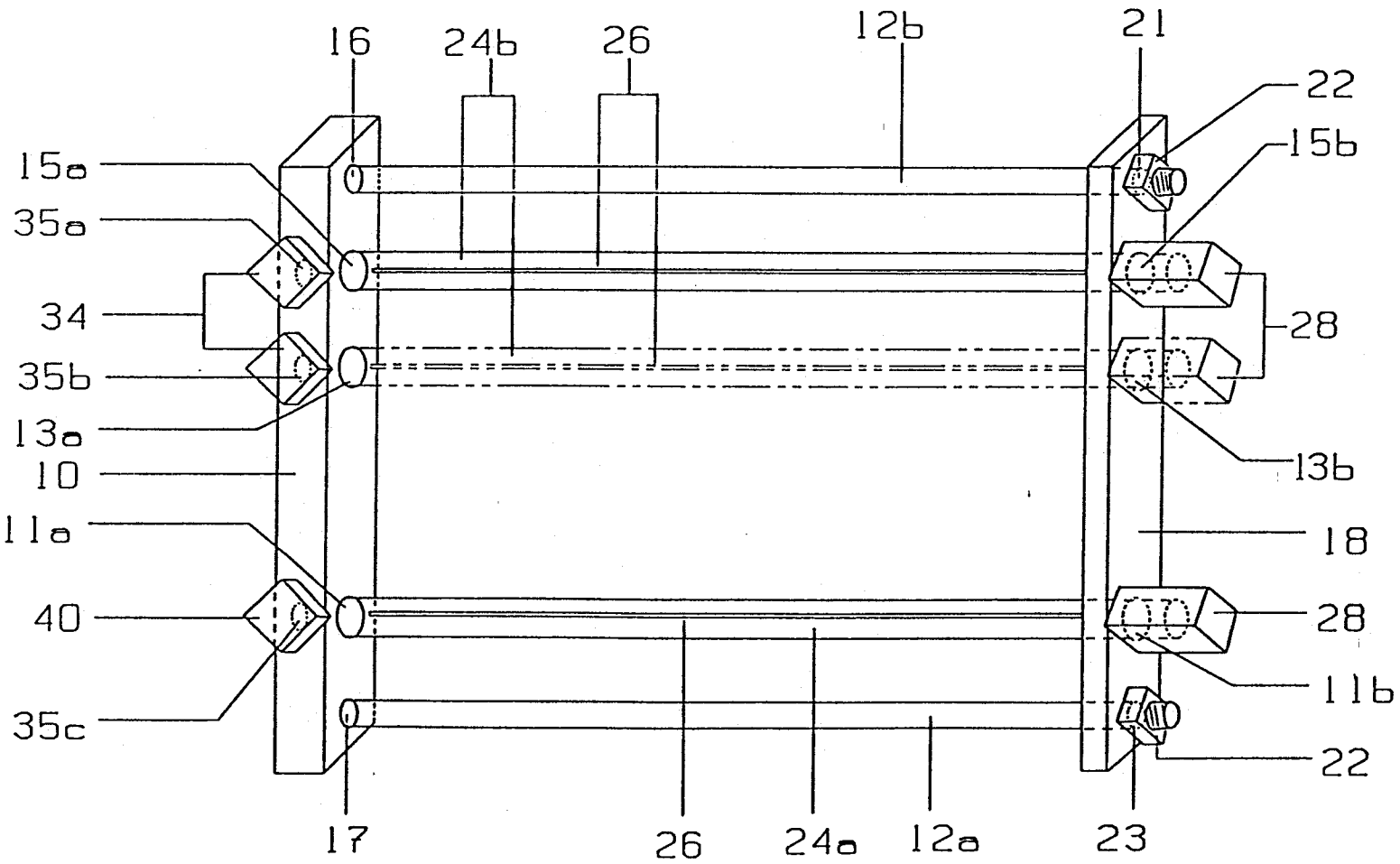
Figure 2:
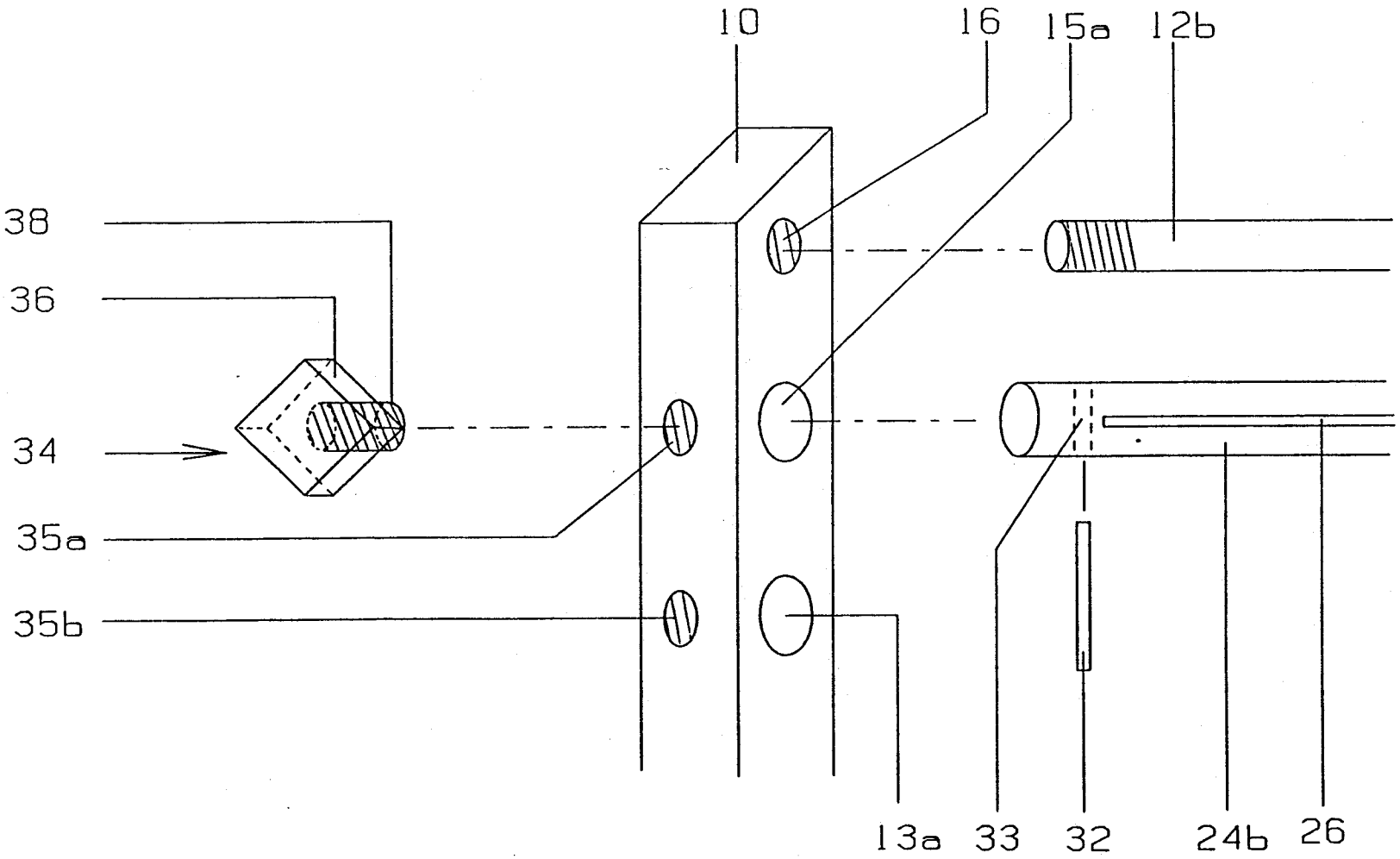

Upper clamp knob 34 (FIG. 2) is comprised of knob 36 affixed to threaded rod 38. The upper clamp knob screws down into either upper clamp knob hole 35*a* or middle clamp knob hole 35*b* and, when tightened, applies direct pressure on rear scroller rod 24*b*. Lower clamp knob 40 (FIG. 1) is identical in construction to upper clamp knob and screws into lower clamp knob hole 35*c* to apply direct pressure on front scroller rod 24*a*.

DESCRIPTION OF THE PREFERRED EMBODIMENT

To assemble the Needlework Scroller, the frame braces are first fastened to the primary upright frame support by identifying the end of each frame brace through which the frame brace stop peg does not pass. This end of each frame brace is threaded into a lateral female threaded hole of the primary upright frame support until tight. The other end of each frame brace passes through the small outer holes of the secondary upright frame support until the frame brace stop pegs contact the inner surface of the secondary upright frame support. Frame brace nuts are then threaded onto the ends of the frame braces which protrude through the secondary upright frame support, forming a rigid, rectangular frame.

Next, a washer is slid over the end of each scroller rod until the washer contacts the scroller knob. A scroller rod is inserted through the large lower hole of the secondary upright frame support then through the large lower hole of the primary upright frame support. The other scroller rod is inserted through either of the upper pair of holes in the primary and secondary upright frame supports to best accommodate the length of fabric being stitched. Finally, a scroller rod stop peg is inserted into the holes in the end of the scroller rods which protrude through the primary upright frame support.

A clamp knob is then threaded into each of the two vertically oriented threaded holes on the upper surface of the primary upright frame support.

In preparation for fabric mounting on the Needlework Scroller, the user first defines the preferred working area height by positioning the rear scroller rod through either the upper or lower holes located in the top half of the primary and secondary upright frame supports. The fabric to be stitched upon is then threaded through the fabric slot in the rear scroller rod until approximately one inch protrudes through the slot. The rear scroller knob is then rotated clockwise until approximately half of the fabric is wrapped around the rear scroller rod. The rear clamp knob is then tightened onto the rear scroller rod until the rear scroller rod is immobilized. Next, the other end of the fabric is inserted through the slot of the front scroller rod and the front scroller rod is rotated counter clockwise until the remaining fabric is wrapped around the front scroller rod and the fabric exposed in the work area between the two scroller rods is tight. The front clamp knob is then tightened onto the front scroller rod while holding onto the front scroller knob to maintain fabric tension.

The frame is held in one hand while stitching with the other hand or by resting the frame in the lap enabling free use of both hands. When the fabric in the work area is fully stitched, the user may loosen both clamp knobs and rotate a scroller knob, thus scrolling a different section of the fabric into the work area without touching the fabric.

SUMMARY, RAMIFICATIONS, AND SCOPE

Accordingly, the reader can see that the Needlework Scroller provides a rigid stitching frame which maximizes stitching efficiency through ease of adjustment, disassembly, and fabric mounting. Further improvements are evident in that it enables adjustment of fabric into and out of the work area without touching the fabric;

it enables effective mounting of fabric onto the scroller rods without use of adhesives, staples, or other relatively complex methods;

it maintains rigidity at all times, ensuring even fabric tension;

it provides the user a choice of two different work area sizes;

length of frame braces and scroller rods is chosen to best accommodate fabric being mounted.

it is easily transportable due to its ease of assembly and disassembly;

it is a simple overall form, enabling effective product marketing due to affordability;

all components are crafted from wood, reducing manufacturing costs and providing a pleasing aesthetic appearance.

Although the above description provides many exact specifications, the scope of this invention should not be limited to only those specifications mentioned, which were used merely to illustrate an effective use of the invention. For example, the components may be constructed of plastic, metal, or other materials and knobs or nuts may be round or hexagonal, as well as square. The invention may also be used for materials other than fabric, such as paper, plastic, or any other flexible material.

Thus the scope of the invention should be determined by the following claim and its legal equivalents, rather than the specifications given as examples.

I claim:

1. A fabric stretching frame device comprising, in combination:

A) a pair of parallel upright frame members, one being a right side upright frame member and the other being a left side upright frame member, said upright members positioned such that the width of the fabric stretching frame device is defined by an area between said upright frame members;

B) a pair of parallel horizontal frame members, one being an upper horizontal frame member and the other being a lower horizontal frame member, said horizontal members positioned such that the height of the fabric stretching frame device is defined by an area between said horizontal frame members, and said horizontal frame members being attached to the aforementioned upright frame members, each horizontal frame member comprising a stop peg and said horizontal frame members are affixed to the aforementioned parallel upright frame members by clamping said parallel upright frame members between said stop pegs and threaded nuts which thread onto the ends of said horizontal frame members forming a rigid frame structure and enabling said fabric stretching frame device to be effectively assembled and disassembled;

C) a pair of parallel horizontal rods, one being an upper horizontal rod and the other being a lower horizontal rod, said rods passing through and perpendicular to the aforementioned upright frame members, said rods having means for attaching and tensioning fabric thereto, said fabric being wrappable around said parallel horizontal rods and a work area of said fabric is defined by an area between said parallel horizontal rods;

D) a means for immobilizing the aforementioned parallel horizontal rods consisting of threaded rods passing through said upright frame members for applying pressure to said horizontal rods through direct physical contact, whereby fabric tension is maintained between said horizontal rods.

* * * * *